US011927002B2

(12) United States Patent
Yazdani

(10) Patent No.: US 11,927,002 B2
(45) Date of Patent: Mar. 12, 2024

(54) HAIR ENTRAPMENT FILTER SYSTEM

(71) Applicant: Kamran Yazdani, Scarborough (CA)

(72) Inventor: Kamran Yazdani, Scarborough (CA)

( * ) Notice: Subject to any disclaimer, the term of this patent is extended or adjusted under 35 U.S.C. 154(b) by 551 days.

(21) Appl. No.: 17/239,219

(22) Filed: Apr. 23, 2021

(65) Prior Publication Data

US 2022/0341139 A1 Oct. 27, 2022

(51) Int. Cl.
*E03C 1/264* (2006.01)

(52) U.S. Cl.
CPC ..... *E03C 1/264* (2013.01)

(58) Field of Classification Search
None
See application file for complete search history.

(56) References Cited

U.S. PATENT DOCUMENTS 212,614 A * 2/1879 Magee ..... E03C 1/264 4/291
214,982 A * 5/1879 Atwater ..... E03C 1/264 4/291
214,983 A * 5/1879 Atwater ..... E03C 1/264 4/287
241,739 A * 5/1881 Slow ..... E03C 1/264 4/292
243,002 A * 6/1881 Stevens ..... E03C 1/264 4/286
243,648 A * 6/1881 Stimpson ..... E03C 1/264 4/291
263,696 A * 9/1882 Granlees ..... E03C 1/264 4/291
267,306 A * 11/1882 Gall ..... F16K 3/0281 4/256.1
270,979 A * 1/1883 Pike ..... F41A 29/02 15/104.16
271,358 A * 1/1883 Pike ..... E03D 9/00 15/88.4
287,246 A * 10/1883 Coomber ..... E03C 1/264 4/291
335,363 A * 2/1886 Keech ..... E03C 1/264 4/292
412,195 A * 10/1889 Marker ..... E03C 1/264 285/368
506,872 A * 10/1893 Chase ..... E03C 1/264 4/295

(Continued)

FOREIGN PATENT DOCUMENTS

CA 3116267 A1 * 10/2022 ..... E03C 1/264
CA 3116267 C * 10/2023 ..... E03C 1/264

*Primary Examiner* — Robert J Popovics
(74) *Attorney, Agent, or Firm* — Aird & McBurney LP

(57) ABSTRACT

A hair entrapment device for retaining loose hair entering a drainage well of a drain, the device comprising: an annular sleeve body having an upper open end and a lower open end respectively defining a top opening and a bottom opening; and a sidewall extending between the upper open end and the lower open end; a central hub; spokes extending between the central hub and portions of an inner surface of the sidewall, and defining spoke openings between the central hub, the spokes and the inner surface; a plurality of tines extending from the spokes towards the top opening; and wherein fluid flows via the top opening, the spoke openings and the bottom opening into the drain and loose hair is retained by the plurality of tines.

17 Claims, 9 Drawing Sheets

(56) References Cited

U.S. PATENT DOCUMENTS 566,570 A * 8/1896 Frick ..... A24F 9/06 131/245
594,169 A * 11/1897 Catsiff ..... E03C 1/264 4/256.1
596,763 A * 1/1898 Stretch ..... E03C 1/264 4/291
628,146 A * 7/1899 Hungerbuehler ..... E03C 1/264 4/291
769,001 A * 8/1904 Lawrence ..... E03C 1/264 4/291
782,860 A * 2/1905 Lever ..... E03C 1/264 285/192
852,044 A * 4/1907 Van Der Minden .... E03C 1/264 4/291
858,234 A * 6/1907 Treager ..... E03C 1/264 210/454
861,493 A * 7/1907 Bell ..... B01D 35/02 210/447
929,727 A * 8/1909 Sullivan ..... E03C 1/264 285/305
972,676 A * 10/1910 Bropson ..... E03C 1/264 4/652
976,593 A * 11/1910 Newsome ..... E03C 1/302 4/256.1
989,410 A * 4/1911 Peters ..... E03C 1/264 4/291
999,106 A * 7/1911 Hagaman et al. ..... B01D 35/30 43/65
1,014,223 A * 1/1912 Hunsicker ..... E03C 1/264 4/291
1,035,733 A * 8/1912 Pierce ..... E03C 1/264 4/291
1,161,766 A * 11/1915 Ferran ..... E03C 1/264 166/227
1,217,763 A * 2/1917 Hirrich ..... E03C 1/282 15/104.095
1,292,856 A * 1/1919 Niblo ..... E03C 1/262 4/652
1,333,433 A * 3/1920 Maisano ..... E03C 1/264 4/291
1,342,046 A * 6/1920 Heino ..... E03C 1/264 285/192
1,356,841 A * 10/1920 Utley ..... 294/100
1,390,345 A * 9/1921 Dunn ..... E03C 1/264 4/292
1,424,022 A * 7/1922 Lacoste ..... E03C 1/264 4/291
1,467,772 A * 9/1923 Appelhoff ..... E03C 1/264 4/291
1,494,882 A * 5/1924 Barger ..... E03C 1/264 4/292
1,515,073 A * 11/1924 Savard ..... E03C 1/264 4/289
1,568,392 A * 1/1926 Abernathy ..... E03F 9/002 15/104.31
1,589,544 A * 6/1926 Natow ..... E03C 1/264 4/290
1,593,087 A * 7/1926 Nelson ..... E03C 1/264 4/291
1,608,347 A * 11/1926 Thompson ..... B08B 9/0553 15/104.061
1,608,966 A * 11/1926 Tanaka ..... E03C 1/282 210/453
1,612,588 A * 12/1926 Lacoste ..... E03C 1/264 4/291
1,661,983 A * 3/1928 Wentzel ..... E03C 1/264 4/291
1,706,000 A * 3/1929 Settles ..... E03C 1/264 4/291
1,730,083 A * 10/1929 Melfi ..... E03C 1/264 4/292
1,756,290 A * 4/1930 Hibner ..... E03C 1/264 4/289
1,757,977 A * 5/1930 Salvatore ..... E03C 1/264 4/292
1,763,864 A * 6/1930 Robertson ..... E03C 1/264 4/289
1,770,639 A * 7/1930 Sanders ..... E03C 1/23 4/286
1,817,283 A * 8/1931 Worswick ..... E03C 1/264 4/291
1,817,376 A * 8/1931 Izquierdo ..... E03C 1/282 4/256.1
1,820,673 A * 8/1931 Oakley ..... E03C 1/264 285/376
1,835,447 A * 12/1931 Alland ..... E03C 1/264 4/287
1,886,676 A * 11/1932 Heuacker ..... E03C 1/264 4/256.1
1,935,128 A * 11/1933 Pullman ..... E03C 1/264 4/DIG. 14
1,935,361 A * 11/1933 Kaplan ..... A47K 1/14 4/295
1,950,817 A * 3/1934 Rossman ..... E03C 1/264 4/291
1,996,279 A * 4/1935 Dillon ..... E03C 1/264 D23/209
2,024,475 A * 12/1935 Rossman ..... E03C 1/264 4/287
2,038,852 A * 4/1936 Pasman ..... E03C 1/264 4/291
2,043,088 A * 6/1936 Zinkil ..... A47K 1/14 4/689
2,048,704 A * 7/1936 Kraus ..... E03C 1/264 4/286
2,075,443 A * 3/1937 Kirschner ..... E03C 1/262 4/287
2,077,516 A * 4/1937 Dart ..... E03C 1/308 4/286
2,119,923 A * 6/1938 McIntyre ..... E03F 5/08 210/247
2,140,436 A * 12/1938 Vanerstrom ..... E03C 1/264 4/674
2,225,693 A * 12/1940 Frances ..... E03C 1/264 4/291
2,233,234 A * 2/1941 Wilson ..... E03C 1/264 4/291
2,285,833 A * 6/1942 Platt ..... E03C 1/264 239/548
2,317,707 A * 4/1943 Yavitch ..... E03C 1/264 4/292
2,331,055 A * 10/1943 Smith ..... E03C 1/264 4/291
2,348,093 A * 5/1944 Pasman ..... E03C 1/23 4/287
2,440,165 A * 4/1948 Behrend ..... E03C 1/264 4/652
2,505,305 A * 4/1950 Schaefer ..... E03C 1/264 4/289
2,506,669 A * 5/1950 Heuacker ..... E03C 1/264 220/86.3
2,512,394 A * 6/1950 Sullivan ..... D06F 39/10 D23/209
2,548,541 A * 4/1951 MacDonald ..... E03C 1/282 210/434
2,690,232 A * 9/1954 Brem ..... E03C 1/282 210/450
2,690,569 A * 10/1954 Kozerski ..... E03C 1/264 4/292
2,693,603 A * 11/1954 Lehmann ..... E03D 9/00 4/256.1
2,909,788 A * 10/1959 Van Der Bel ..... E03C 1/264 4/256.1
3,021,528 A * 2/1962 Hargrave ..... D06F 41/00 4/256.1
3,144,408 A * 8/1964 Restituto ..... E03C 1/264 210/538

(56) References Cited

U.S. PATENT DOCUMENTS 3,268,920 A * 8/1966 Beer ..... E03C 1/264 210/163
3,466,901 A * 9/1969 Reid ..... D06F 39/10 210/167.01
3,665,526 A * 5/1972 Hoffman ..... A47K 1/14 4/287
3,702,013 A * 11/1972 Gebert ..... E03C 1/26 4/292
3,742,524 A * 7/1973 Ballentine ..... E03C 1/264 4/654
3,757,375 A * 9/1973 Strom ..... B08B 9/045 15/104.18
3,872,521 A * 3/1975 Friedman ..... E03C 1/284 15/104.16
3,935,602 A * 2/1976 Kale ..... E03C 1/282 4/DIG. 14
3,959,831 A * 6/1976 Hendricks ..... E03C 1/264 4/DIG. 14
3,977,219 A * 8/1976 Bochan ..... D06F 39/10 210/411
3,982,289 A * 9/1976 Robbins ..... E03C 1/264 4/292
4,032,455 A * 6/1977 Kale ..... B01D 35/28 4/256.1
4,044,409 A * 8/1977 Hood ..... E03C 1/264 4/286
4,045,351 A * 8/1977 Peterson ..... B01D 35/02 4/652
4,164,048 A * 8/1979 Kampfer ..... E03C 1/282 4/DIG. 14
4,179,762 A * 12/1979 Barnhardt ..... E03C 1/284 4/256.1
4,199,827 A * 4/1980 Tuleja ..... E03C 1/282 4/290
4,207,631 A * 6/1980 Baggey ..... E03C 1/264 4/291
4,230,582 A * 10/1980 Tuleja ..... B01D 35/02 4/679
4,253,211 A * 3/1981 Mockel ..... E03D 9/00 15/105
4,301,554 A * 11/1981 Wojcicki ..... E03C 1/282 4/256.1
4,307,476 A * 12/1981 Halstad ..... E03D 11/00 4/256.1
4,344,544 A * 8/1982 Austin ..... B60K 15/0403 220/86.3
4,380,834 A * 4/1983 Wentz ..... E03C 1/23 4/286
4,418,432 A * 12/1983 Vidal ..... A47K 1/14 428/34.1
4,443,897 A * 4/1984 Austin ..... E03C 1/26 4/291
4,457,030 A * 7/1984 Burry ..... A47K 1/14 215/311
4,490,862 A * 1/1985 Vidal ..... E03C 1/26 4/292
4,539,718 A * 9/1985 Haer ..... E03C 1/264 4/256.1
4,555,818 A * 12/1985 Harrington ..... E03C 1/26 4/256.1
4,671,976 A * 6/1987 Vidal ..... E03C 1/264 4/293
4,825,477 A * 5/1989 Aranda ..... E03C 1/264 4/293
D308,720 S * 6/1990 Yuen ..... D8/13
4,932,080 A * 6/1990 Pino ..... E03F 7/00 4/256.1
4,932,082 A * 6/1990 Ridgeway ..... E03C 1/2302 4/287
4,949,406 A * 8/1990 Canelli ..... E03C 1/282 4/256.1
4,996,725 A * 3/1991 Pino ..... E03F 7/00 4/256.1
4,999,858 A * 3/1991 Wu ..... E03C 1/26 4/290
D316,594 S * 4/1991 Yuen ..... D23/261
5,003,642 A * 4/1991 Robb ..... E03C 1/262 4/292
5,027,447 A * 7/1991 Pino ..... E03F 7/00 4/256.1
5,038,816 A * 8/1991 Weltsch ..... E03C 1/282 4/DIG. 14
5,241,979 A * 9/1993 Chang ..... B01D 29/031 137/550
5,251,339 A * 10/1993 Piskula ..... E03C 1/30 15/104.32
D341,413 S * 11/1993 Nichols ..... D23/261
5,265,281 A * 11/1993 McAlpine ..... E03C 1/262 4/290
5,267,361 A * 12/1993 Lai ..... E03C 1/282 4/256.1
5,271,108 A * 12/1993 Wicke ..... E03C 1/26 4/292
5,297,299 A * 3/1994 Wilson ..... E03C 1/264 4/290
5,428,847 A * 7/1995 Atkins ..... E03C 1/23 4/295
5,442,819 A * 8/1995 Penor ..... E03C 1/26 4/288
5,525,215 A * 6/1996 Marchionda ..... B01D 29/117 210/162
5,546,614 A * 8/1996 King, II ..... E03C 1/264 4/256.1
5,638,557 A * 6/1997 Iida ..... B01D 21/00 4/DIG. 14
5,769,960 A * 6/1998 Nirmel ..... E03C 1/302 15/104.31
5,836,032 A * 11/1998 Hondo ..... E03C 1/30 15/104.001
5,915,847 A * 6/1999 Spears ..... E03C 1/262 4/293
5,978,981 A * 11/1999 Nelson ..... E04H 4/1236 210/163
6,067,669 A * 5/2000 Peterson ..... E03C 1/262 4/291
6,088,843 A * 7/2000 Francisco ..... E03C 1/264 4/290
6,088,844 A * 7/2000 Killham ..... E03C 1/262 4/295
D429,820 S * 8/2000 Meske ..... D24/217
6,108,828 A * 8/2000 Cheng ..... A47K 1/14 4/286
6,138,290 A * 10/2000 Lin ..... A47K 1/14 4/293
6,153,095 A * 11/2000 Francisco ..... E03C 1/282 210/453
6,163,896 A * 12/2000 Lee ..... E03C 1/264 4/286
D435,944 S * 1/2001 Luoma ..... D32/14
6,173,455 B1 * 1/2001 Nordstrom ..... E03C 1/264 4/292
D439,957 S * 4/2001 Barnett ..... D23/261
6,263,518 B1 * 7/2001 Magtanong ..... E03C 1/26 4/290
6,308,350 B1 * 10/2001 Marchionda ..... E03C 1/282 4/679
D450,106 S * 11/2001 Herr ..... D23/261
6,341,391 B1 * 1/2002 Cheng ..... E03C 1/2302 4/689
6,387,261 B1 * 5/2002 Mojena ..... B01D 24/042 210/488
D458,426 S * 6/2002 Kovach ..... D32/35
6,487,729 B2 * 12/2002 Delanzo ..... E03C 1/264 4/286
6,558,538 B2 * 5/2003 Scuilla ..... E03C 1/126 4/679

(56) References Cited

U.S. PATENT DOCUMENTS 6,676,842 B2 * 1/2004 Scuilla ..... E03C 1/126 210/764
6,775,873 B2 * 8/2004 Luoma ..... E03C 1/302 15/104.001
6,880,178 B2 * 4/2005 Pino ..... E03D 9/00 4/256.1
6,915,814 B2 * 7/2005 Cheng ..... E03C 1/126 137/546
6,920,663 B2 * 7/2005 Petit ..... B08B 9/0436 15/104.001
D511,278 S * 11/2005 Carfagnini ..... D8/19
D518,252 S * 3/2006 Wu ..... D32/14
7,128,834 B2 * 10/2006 Davenport ..... B01D 35/02 4/DIG. 14
7,150,576 B1 * 12/2006 Kambeyanda ..... E03C 1/282 401/292
D550,819 S * 9/2007 Seehoff ..... D23/261
D553,226 S * 10/2007 Wisek ..... D23/268
7,376,983 B1 * 5/2008 Sciarrino ..... E03C 1/264 4/288
7,407,142 B1 * 8/2008 Lopez ..... A45D 44/16 248/205.2
7,442,296 B2 * 10/2008 Chong ..... E03C 1/264 4/290
7,531,088 B2 * 5/2009 Gurmu ..... E03C 1/282 4/291
D604,809 S * 11/2009 Mannella ..... D23/260
D605,733 S * 12/2009 Cavalieri ..... D23/261
7,625,488 B2 * 12/2009 Blackburn ..... E03C 1/264 4/679
7,650,651 B2 * 1/2010 Lohnert ..... A47K 1/14 4/295
D610,761 S * 2/2010 Gengler ..... D32/35
7,704,386 B2 * 4/2010 Ventura ..... E03C 1/264 210/474
7,725,960 B2 * 6/2010 Markaj ..... B01D 35/10 4/290
7,736,499 B2 * 6/2010 Chong ..... E03C 1/264 4/290
7,774,890 B1 * 8/2010 Weiss, Jr. ..... E03C 1/264 15/160
7,799,216 B2 * 9/2010 Gurmu ..... E03C 1/282 4/291
7,802,739 B2 * 9/2010 Scorvo ..... E03C 1/266 241/46.013
7,810,176 B2 * 10/2010 Turner ..... E03C 1/302 4/255.01
7,854,852 B1 * 12/2010 Reavis ..... E03B 1/04 210/767
7,861,329 B2 * 1/2011 Markaj ..... B01D 35/10 4/290
D639,623 S * 6/2011 Tash ..... D32/14
8,011,030 B2 * 9/2011 Li ..... E03C 1/262 4/286
D649,723 S * 11/2011 Zach ..... D32/14
D649,724 S * 11/2011 Zach ..... D32/14
D650,471 S * 12/2011 Du ..... D23/268
D652,184 S * 1/2012 Zach ..... D32/14
D654,152 S * 2/2012 Schulz ..... D23/260
D655,466 S * 3/2012 Zach ..... D32/14
D657,099 S * 4/2012 Zach ..... D32/14
D658,342 S * 4/2012 Danak ..... D32/25
D659,918 S * 5/2012 Zach ..... D32/14
D669,969 S * 10/2012 Forrest ..... D23/261
8,316,474 B2 * 11/2012 Kang ..... E03C 1/282 4/292
8,365,337 B2 * 2/2013 Tash ..... B08B 9/045 15/104.03
8,382,993 B1 * 2/2013 Wisek ..... E03C 1/26 137/550
8,505,125 B1 * 8/2013 Chia ..... E03C 1/264 4/290
8,584,297 B2 * 11/2013 Tash ..... B08B 9/045 15/104.03
8,590,065 B2 * 11/2013 Ali ..... E03C 1/262 4/287
8,628,657 B1 * 1/2014 Robillard ..... B01D 35/02 52/302.1
D707,406 S * 6/2014 Dennis ..... D32/14
8,739,968 B2 * 6/2014 Bates ..... E03C 1/304 206/223
8,745,771 B2 * 6/2014 Bates ..... E03C 1/304 4/255.04
8,757,268 B2 * 6/2014 LeJeune ..... E21B 21/10 166/325
8,813,272 B2 * 8/2014 Ball ..... A47K 1/14 4/286
8,834,714 B2 * 9/2014 Chien ..... E03F 1/00 210/166
8,910,322 B2 * 12/2014 Briggs ..... E03C 1/264 4/255.01
9,021,621 B2 * 5/2015 Booker, Jr. ..... E03C 1/262 4/290
9,060,656 B2 * 6/2015 Tong ..... E03C 1/23
9,131,810 B2 * 9/2015 Reile ..... A47K 3/281
9,131,988 B2 * 9/2015 Bagwell ..... A61M 16/0434
9,194,114 B2 * 11/2015 Petry ..... E03C 1/302
D746,417 S * 12/2015 Guterman ..... D23/260
9,217,243 B2 * 12/2015 Gwen ..... E03C 1/302
9,334,181 B2 * 5/2016 Worth ..... E03F 5/041
9,371,636 B2 * 6/2016 Ali ..... A47K 1/14
9,499,962 B2 * 11/2016 Joseph ..... E03C 1/262
9,518,383 B2 * 12/2016 Lesmeister ..... E03C 1/264
9,534,365 B2 * 1/2017 Briggs ..... E03F 5/041
D783,134 S * 4/2017 Karnegie ..... D23/261
9,611,630 B2 * 4/2017 Danhi ..... E03C 1/22
9,611,631 B2 * 4/2017 Rosko ..... E03C 1/2302
9,624,656 B2 * 4/2017 Colacino ..... E03C 1/262
D785,767 S * 5/2017 Karnegie ..... E03C 1/264 D23/261
D792,562 S * 7/2017 Ali ..... D23/261
D794,759 S * 8/2017 Karnegie ..... D23/261
9,719,237 B2 * 8/2017 Hsu ..... B08B 9/0436
9,797,122 B2 * 10/2017 Maalouf ..... E03D 9/00
D814,611 S * 4/2018 Karnegie ..... D23/261
9,945,106 B2 * 4/2018 Ali ..... E03C 1/262
9,945,108 B1 * 4/2018 Turner ..... B08B 9/045
D817,463 S * 5/2018 Curley ..... D23/260
9,976,295 B1 * 5/2018 Booker, Jr. ..... E03C 1/20
9,987,027 B2 * 6/2018 Ben-Ami ..... A61B 17/22031
9,994,465 B2 * 6/2018 Epstein ..... E03F 5/041
D824,495 S * 7/2018 D'Amico ..... D23/261
10,024,039 B2 * 7/2018 Cheng ..... E03C 1/264
10,036,154 B2 * 7/2018 Crevier ..... E03D 13/005
10,053,960 B2 * 8/2018 Romero ..... E21B 21/003
D827,787 S * 9/2018 Karnegie ..... D23/261
D827,788 S * 9/2018 Karnegie ..... D23/261
D828,523 S * 9/2018 Karnegie ..... D23/261
10,066,382 B2 * 9/2018 Muderlak ..... E03D 13/007
10,072,405 B2 * 9/2018 Beck ..... E03C 1/302
D832,408 S * 10/2018 St-Antoine ..... D23/261
10,106,967 B2 * 10/2018 Sebolt ..... E03C 1/262
10,119,257 B2 * 11/2018 Briggs ..... E03C 1/264
10,119,258 B2 * 11/2018 Briggs ..... E03C 1/264
D838,818 S * 1/2019 Malesky ..... D23/261
10,184,234 B2 * 1/2019 Vong ..... E03C 1/22
D840,000 S * 2/2019 Yoshihara ..... D23/260
D841,133 S * 2/2019 Karnegie ..... D23/261
10,221,550 B2 * 3/2019 Colacino ..... E03C 1/264
10,267,027 B2 * 4/2019 D'Amico ..... A61L 9/05
10,294,649 B2 * 5/2019 Crevier ..... E03D 13/005
10,301,803 B2 * 5/2019 Beck ..... E03C 1/262
D851,225 S * 6/2019 Karnegie ..... D23/261
10,309,085 B1 * 6/2019 Choy ..... E03C 1/262
10,344,460 B2 * 7/2019 Karnegie ..... E03C 1/264
10,422,114 B2 * 9/2019 Nahum ..... E03C 1/22
D862,664 S * 10/2019 Si ..... D23/261
D867,551 S * 11/2019 Xiang ..... D23/261
10,486,990 B2 * 11/2019 Epstein ..... E03F 5/06
10,501,917 B2 * 12/2019 Ali ..... E03C 1/262

(56) References Cited

U.S. PATENT DOCUMENTS 10,519,638 B2 * 12/2019 Schuster ..... E03C 1/262
D873,972 S * 1/2020 Hayes ..... D23/261
D873,975 S * 1/2020 Chen ..... D23/261
10,570,594 B2 * 2/2020 Karnegie ..... E03C 1/262
10,570,595 B2 * 2/2020 Sebolt ..... E03C 1/2302
10,570,596 B1 * 2/2020 Schneck ..... E03C 1/26
10,577,785 B2 * 3/2020 Schuster ..... E03C 1/262
D880,660 S * 4/2020 Chen ..... D23/261
10,626,591 B2 * 4/2020 Muderlak ..... E03D 9/03
10,626,707 B2 * 4/2020 Gao ..... E21B 33/14
10,639,568 B1 * 5/2020 Carter ..... B01D 35/02
10,648,256 B2 * 5/2020 Romero ..... E21B 21/003
D886,247 S * 6/2020 Nilsen ..... D23/261
10,677,019 B2 * 6/2020 Romero ..... E21B 28/00
10,683,648 B2 * 6/2020 Beck ..... B25G 3/34
D890,889 S * 7/2020 Liu ..... D23/261
D890,890 S * 7/2020 Liu ..... D23/261
10,765,198 B2 * 9/2020 Watne ..... A46B 1/00
10,767,803 B2 * 9/2020 Mainzer ..... F16J 13/12
10,772,647 B2 * 9/2020 Ben-Ami ..... A61B 17/22031
10,786,268 B2 * 9/2020 Ben-Ami ..... A61B 17/22031
D900,285 S * 10/2020 Liu ..... D23/261
10,791,819 B2 * 10/2020 Caccamise ..... A45D 44/16
D900,982 S * 11/2020 Rosario ..... D23/261
D901,240 S * 11/2020 Armistead ..... D23/209
D901,646 S * 11/2020 Chen ..... D23/261
D901,794 S * 11/2020 Schutte ..... D32/14
D904,577 S * 12/2020 Lian ..... D23/261
D905,206 S * 12/2020 Colacino ..... D23/261
10,857,577 B2 * 12/2020 Turner ..... B08B 9/04
10,870,976 B2 * 12/2020 Karnegie ..... E03C 1/264
10,982,425 B1 * 4/2021 Grumbach ..... E03F 5/041
11,001,996 B2 * 5/2021 Heipp ..... E03C 1/232
11,035,110 B1 * 6/2021 Wright ..... E03C 1/264
11,045,843 B2 * 6/2021 Lyne ..... D06F 58/22
11,047,181 B2 * 6/2021 Romero ..... E21B 21/003
11,066,819 B2 * 7/2021 Rosario ..... E03C 1/262
D931,422 S * 9/2021 Drossman ..... D23/261
11,122,946 B2 * 9/2021 Nguyen ..... A47L 9/325
11,142,897 B2 * 10/2021 Schuster ..... B01D 29/31
11,162,251 B2 * 11/2021 Beck ..... E03C 1/262
11,180,912 B2 * 11/2021 Chaves ..... E03F 5/0408
11,198,994 B1 * 12/2021 Cebull ..... E03C 1/22
D940,836 S * 1/2022 Beck ..... D23/261
D943,225 S * 2/2022 Wilsey ..... D32/14
11,242,676 B2 * 2/2022 Wang ..... E03C 1/262
11,242,678 B2 * 2/2022 Grumbach ..... C02F 3/342
11,371,227 B2 * 6/2022 Cobb ..... E03C 1/264
11,391,027 B1 * 7/2022 Ali ..... A47K 1/14
11,421,408 B1 * 8/2022 Rosario ..... E03C 1/262
11,434,630 B1 * 9/2022 Shah ..... B01D 35/28
11,445,804 B1 * 9/2022 Heacock ..... A46B 9/023
D967,352 S * 10/2022 McClure ..... D23/261
D968,731 S * 11/2022 Ye ..... D32/14
D969,425 S * 11/2022 Zhang ..... D32/14
11,505,931 B2 * 11/2022 Cheng ..... E03C 1/282
11,505,935 B2 * 11/2022 Crevier ..... E03D 13/005
D972,093 S * 12/2022 Shah ..... D23/261
11,519,161 B2 * 12/2022 Ahuja ..... E03C 1/232
11,519,162 B1 * 12/2022 Amendariz ..... E03D 11/16
11,519,164 B1 * 12/2022 Crevier ..... E03D 13/005
D976,371 S * 1/2023 Zhu ..... D23/261
11,608,620 B2 * 3/2023 Rosario ..... E03C 1/2302
11,608,621 B1 * 3/2023 Pilarczyk ..... E03C 1/22
11,680,397 B2 * 6/2023 Ahuja ..... E03C 1/2306 4/295
D992,094 S * 7/2023 Ramkarran ..... D23/261
D992,698 S * 7/2023 Ramkarran ..... D23/261
11,753,806 B2 * 9/2023 Gwen ..... E03C 1/264 210/787
11,753,812 B2 * 9/2023 Heide ..... E03F 5/14 210/799
11,773,574 B2 * 10/2023 Ali ..... E03C 1/2306 4/295
11,839,839 B2 * 12/2023 Choi ..... B01D 35/02
2002/0050473 A1 * 5/2002 Davenport ..... E03C 1/264 210/447
2002/0144338 A1 * 10/2002 Delanzo ..... E03C 1/264 4/286
2004/0144703 A1 * 7/2004 Davenport ..... E03C 1/264 210/447
2004/0255378 A1 * 12/2004 Tracy ..... E03C 1/26 4/689
2005/0223481 A1 * 10/2005 Giacomi ..... E03C 1/264 4/286
2006/0273002 A1 * 12/2006 Maymudes ..... E03C 1/264 210/162
2007/0033731 A1 * 2/2007 Blackburn ..... E03C 1/264 4/679
2007/0272604 A1 * 11/2007 Chong ..... E03C 1/264 210/163
2008/0168596 A1 * 7/2008 Findlay ..... A61L 9/05 4/287
2008/0169228 A1 * 7/2008 Ventura ..... E03C 1/264 210/164
2008/0178382 A1 * 7/2008 Pinette ..... E03C 1/2306 4/689
2008/0216221 A1 * 9/2008 Markaj ..... B01D 35/10 4/289
2008/0230469 A1 * 9/2008 Cherveny ..... E03C 1/264 210/455
2009/0007321 A1 * 1/2009 Kang ..... E03C 1/282 4/292
2009/0126091 A1 * 5/2009 Buehler ..... E03C 1/126 4/295
2009/0151060 A1 * 6/2009 Zubillaga ..... E03C 1/262 4/292
2009/0172870 A1 * 7/2009 Hong ..... E03C 1/244 4/286
2009/0271919 A1 * 11/2009 Scorvo ..... E03C 1/262 4/287
2009/0271920 A1 * 11/2009 Viggiano ..... E03C 1/264 4/292
2010/0000011 A1 * 1/2010 Angarita ..... E03C 1/262 4/292
2010/0011494 A1 * 1/2010 Dees ..... E03C 1/264 4/292
2010/0071122 A1 * 3/2010 Li ..... E03C 1/262 4/287
2010/0115689 A1 * 5/2010 Thompson ..... E03C 1/264 4/287
2010/0236645 A1 * 9/2010 Markaj ..... B01D 35/10 137/545
2010/0264046 A1 * 10/2010 Bates ..... E03F 9/00 206/223
2011/0089099 A1 * 4/2011 Lee ..... A47K 1/14 210/238
2012/0012510 A1 * 1/2012 Ventura ..... E03C 1/264 210/163
2013/0014336 A1 * 1/2013 Bernstein ..... A47L 11/33 15/143.1
2013/0125299 A1 * 5/2013 Tong ..... A47K 1/14 4/295
2013/0156897 A1 * 6/2013 Goldstein ..... B65D 85/8061 426/115
2013/0185855 A1 * 7/2013 Ali ..... E03C 1/262 4/287
2013/0191982 A1 * 8/2013 Booker, Jr. ..... E03C 1/264 4/290
2013/0205485 A1 * 8/2013 Briggs ..... E03C 1/264 4/689
2013/0269100 A1 * 10/2013 Ball ..... E03C 1/2306 4/693
2014/0007334 A1 * 1/2014 Golibart ..... E03C 1/262 4/287
2014/0165275 A1 * 6/2014 Zito ..... A46B 9/025 4/292
2014/0173819 A1 * 6/2014 Ali ..... A47K 1/14 4/287
2014/0259344 A1 * 9/2014 Muderlak ..... E03D 13/007 4/256.1

(56) References Cited

U.S. PATENT DOCUMENTS

2014/0310862 A1* 10/2014 Joseph ..... E03C 1/262 4/287
2015/0033459 A1* 2/2015 Colacino ..... E03C 1/26 4/287
2015/0089729 A1* 4/2015 Usher ..... E03C 1/264 4/292
2015/0259892 A1* 9/2015 Guterman ..... E03C 1/264 4/291
2015/0275489 A1* 10/2015 Briggs ..... E03C 1/26 4/292
2015/0292191 A1* 10/2015 Cheng ..... E03C 1/264 210/153
2016/0040412 A1* 2/2016 Fetkovich ..... E03C 1/264 4/292
2016/0053472 A1* 2/2016 Rosko ..... E03C 1/2302 4/292
2016/0130793 A1* 5/2016 Lesmeister ..... E03C 1/264 4/287
2016/0215486 A1* 7/2016 Briggs ..... E03F 5/041
2016/0244955 A1* 8/2016 Allred, III ..... E03C 1/26
2016/0251839 A1* 9/2016 Ali ..... E03C 1/2302 4/287
2016/0265204 A1* 9/2016 Zito ..... B08B 9/027
2016/0289935 A1* 10/2016 Hall, Sr. ..... E03C 1/284
2016/0305107 A1* 10/2016 Muderlak ..... E03C 1/264
2016/0309886 A1* 10/2016 Oldham ..... A46B 15/0097
2016/0356029 A1* 12/2016 Davis ..... E03C 1/264
2017/0030060 A1* 2/2017 Ali ..... E03C 1/262
2017/0073948 A1* 3/2017 Terrell ..... A47K 1/14
2017/0073949 A1* 3/2017 Karnegie ..... E03C 1/264
2017/0106512 A1* 4/2017 Raudys ..... B25B 27/06
2017/0107707 A1* 4/2017 Briggs ..... E03C 1/26
2017/0130435 A1* 5/2017 Sebolt ..... E03C 1/2302
2017/0204592 A1* 7/2017 Chen ..... E03C 1/264
2017/0218611 A1* 8/2017 Colacino ..... E03C 1/264
2017/0260724 A1* 9/2017 Beck ..... A47K 1/14
2017/0314244 A1* 11/2017 Beck ..... E03C 1/262
2017/0314245 A1* 11/2017 Beck ..... E03C 1/2306
2018/0064233 A1* 3/2018 Riley ..... A46B 17/02
2018/0100298 A1* 4/2018 Willburn ..... E03C 1/26
2018/0106025 A1* 4/2018 Schuster ..... E03C 1/262
2018/0202136 A1* 7/2018 Karnegie ..... E03C 1/264
2018/0263426 A1* 9/2018 Ahuja ..... E03C 1/2306
2018/0274218 A1* 9/2018 Karnegie ..... E03C 1/262
2018/0290906 A1* 10/2018 Epstein ..... C02F 1/68
2018/0320348 A1* 11/2018 Schuster ..... E03C 1/262
2018/0320349 A1* 11/2018 Schuster ..... E03C 1/264
2018/0328015 A1* 11/2018 Muderlak ..... E03C 1/264
2019/0017255 A1* 1/2019 Ali ..... A47K 1/14
2019/0136494 A1* 5/2019 Chen ..... E03C 1/264
2019/0218758 A1* 7/2019 Karnegie ..... E03C 1/264
2019/0242102 A1* 8/2019 Rosario ..... E03C 1/262
2019/0271142 A1* 9/2019 Swart ..... E03C 1/264
2019/0368184 A1* 12/2019 Lo ..... E03C 1/264
2020/0080291 A1* 3/2020 Hsu ..... E03C 1/264
2020/0215466 A1* 7/2020 Choi ..... H01L 21/67075
2020/0268129 A1* 8/2020 Caccamise ..... A46B 1/00
2020/0284010 A1* 9/2020 Kotapish ..... E03C 1/264
2021/0095460 A1* 4/2021 Chaves ..... E03F 5/041
2021/0164207 A1* 6/2021 Cobb ..... E03C 1/264
2021/0207356 A1* 7/2021 Grumbach ..... E03F 5/0408
2021/0277640 A1* 9/2021 Gwen ..... E03C 1/264
2021/0348372 A1* 11/2021 Patton ..... E03C 1/264
2021/0372105 A1* 12/2021 Wang ..... E03C 1/262
2021/0395986 A1* 12/2021 Ahuja ..... A47K 1/14
2022/0053917 A1* 2/2022 Johansson ..... A45D 19/04
2022/0081891 A1* 3/2022 Chaves ..... E03F 5/0408
2022/0186485 A1* 6/2022 Grumbach ..... E03F 5/0408
2022/0251813 A1* 8/2022 Cheng ..... E03C 1/282
2022/0325511 A1* 10/2022 Rosario ..... E03C 1/264
2022/0341139 A1* 10/2022 Yazdani ..... E03C 1/264
2022/0349165 A1* 11/2022 Hazelton ..... B01D 29/35
2023/0018796 A1* 1/2023 Mayberry ..... E03C 1/264
2023/0123018 A1* 4/2023 Turner ..... E03C 1/302 15/104.09
2023/0125638 A1* 4/2023 Rosario ..... E03C 1/2302 4/287
2023/0358026 A1* 11/2023 Erickson ..... E03C 1/2306
2023/0392359 A1* 12/2023 Hillsten ..... E03C 1/262

* cited by examiner

HAIR ENTRAPMENT FILTER SYSTEM

FIELD

Aspects of this disclosure relate to hair straining devices.

BACKGROUND

Clogged drains or traps associated with bathtubs, sinks and shower stalls are a common household problem, and they can be unsightly, inconvenient, and may result in unpleasant odors. The primary cause for most clogs of traps and drains is the accumulation of loose human hair or pet hair strands shed from hair washing and shampooing, combing, or bathing. The blockages may be removed using a variety of chemical means such drain cleaners, including liquids, gels, powders, and mechanical means such as plungers, hand augers or drain snakes.

SUMMARY

In one example, there is provided a hair entrapment device for retaining loose hair entering a drainage well of a drain, the device comprising:

an annular sleeve body having an upper open end and a lower open end respectively defining a top opening and a bottom opening, and a sidewall extending between the upper open end and the lower open end;

a central hub;

spokes extending between the central hub and portions of an inner surface of the sidewall, and defining spoke openings between the central hub, the spokes and the inner surface of the sidewall;

a plurality of tines extending from the spokes towards the top opening; and wherein fluid flows via the top opening, the spoke openings and the bottom opening into the drain and the loose hair is retained by the plurality of tines.

In another example, there is provided a hair entrapment device comprising:

a central hub having a top end and a bottom end;

a plurality of spokes extending from the central hub and defining openings between the spokes, each of the plurality of spokes opposed sidewalls, a top wall and a bottom wall;

a plurality of tines extending from the top wall; and wherein fluid flows via the openings and loose hair is retained by the plurality of tines.

In another example, there is provided a kit comprising:

a hair entrapment device comprising an annular sleeve body having an upper open end and a lower open end respectively defining a top opening and a bottom opening; and a sidewall extending between the upper open end and the lower open end; a central hub; spokes extending between the central hub and portions of an inner surface of the sidewall, and defining spoke openings between the central hub, the spokes and the inner surface; a plurality of tines extending from the spokes towards the top opening; and a tool comprising a tool body with complementary fingers are snugly received by the spoke openings and engage the inner surface.

In another example, there is provided a method of trapping loose hair entering a drainage well of a drain, the method comprising:

introducing a hair entrapment device into the drainage well; the hair entrapment device comprising an annular sleeve body having an upper open end and a lower open end respectively defining a top opening and a bottom opening; and a sidewall extending between the upper open end and the lower open end; a central hub; spokes extending between the central hub and portions of an inner surface of the sidewall, and defining spoke openings between the central hub, the spokes and the inner surface; a plurality of tines extending from the spokes towards the top opening;

applying a force on the hair entrapment device to cause an outer surface of the sidewall to engage a drain wall of the drain; and whereby fluid flows via the openings into the drain and loose hair is retained by the plurality of tines.

Advantageously, the hair entrapment device reduces or eliminates the use of drain-cleaning chemicals that may be harmful to the environment and/or toxic to breathe or harmful when in contact with the skin or eyes. In addition, the device is easy to use, re-usable, environmentally friendly and relatively inexpensive compared to other tools or chemical means.

DETAILED DESCRIPTION

Figure 1A:
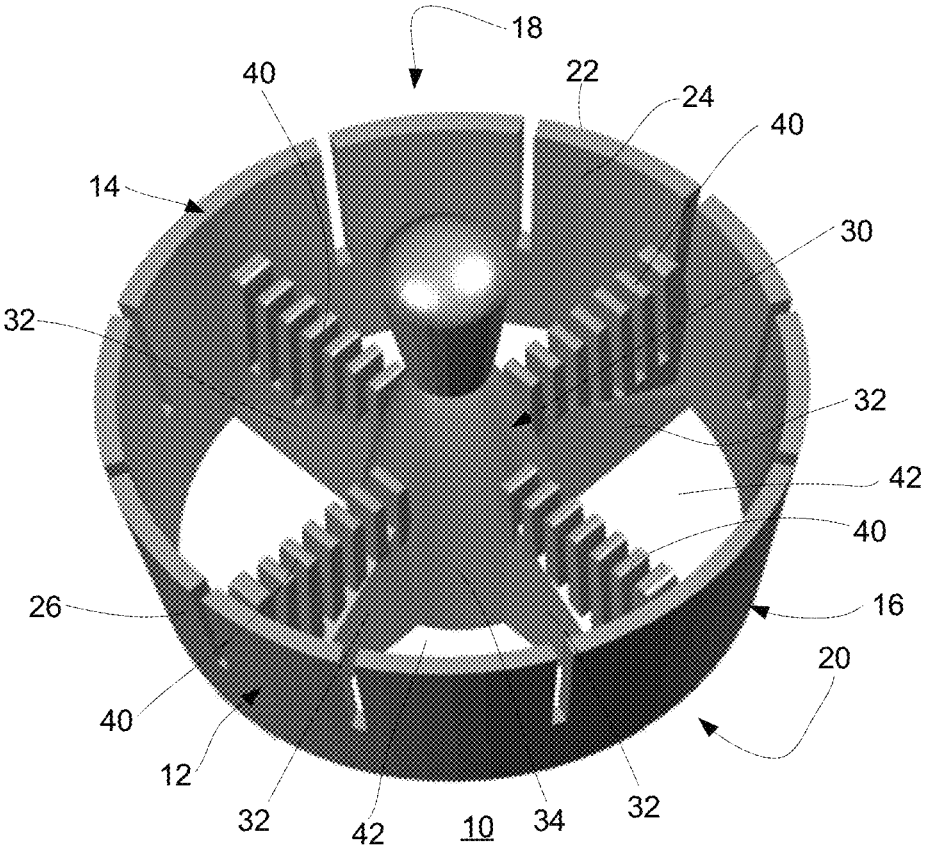
FIG. 1*a* shows a top perspective view of a hair entrapment device, in one embodiment.
Figure 1B:
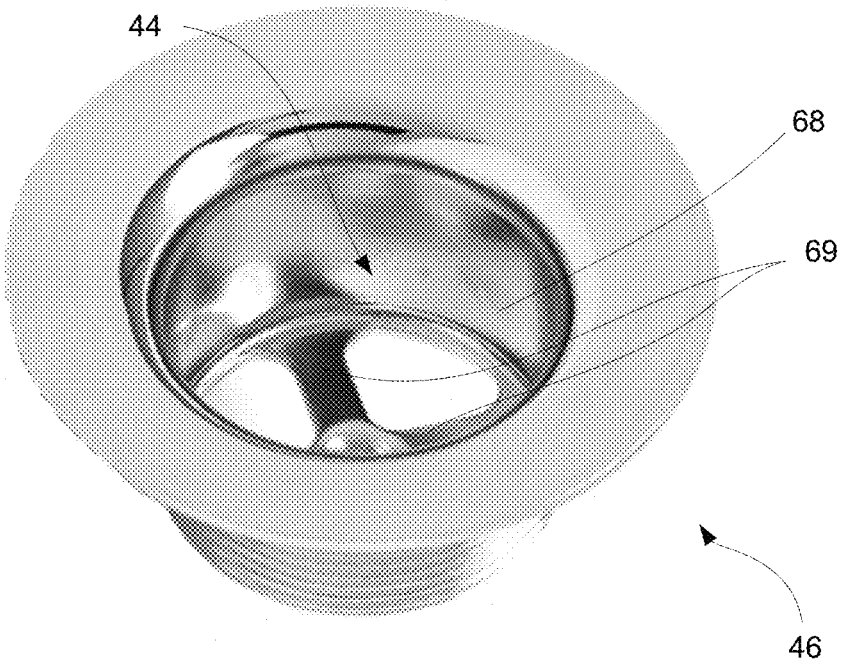
FIG. 1*b* shows a perspective view of a drain.

FIG. 1*a* shows hair entrapment device 10 comprising annular sleeve body 12 having upper open end 14 and lower open end 16 respectively defining a top opening 18 and bottom opening 20; and sidewall 22 extending between upper open end 14 and lower open end 16, comprising inner sleeve wall surface 24 and outer sleeve wall surface 26. Located in the middle of top opening 18 and bottom opening 20 of annular sleeve body 12 is central hub 30 maintained centrally within annular sleeve body 12 by a plurality of spokes 32 which extend from central hub wall 34 of central hub 30 to inner sleeve wall surface 24 of the sidewall 22. Spokes 32 comprise a plurality of tines 40 extending towards top opening 18, and spoke openings 42 are defined between spokes 32, central hub wall 34 and inner sleeve wall surface 24. As shown in FIG. 1*b*, hair entrapment device 10 may be inserted in drainage well 44 of drain 46 associated with a bathtub, a shower stall, a sink, or any other type of drain of any size. After hair entrapment device 10 is installed in drainage well 44, a water tap associated with the bathtub, the shower stall or the sink is turned on during a cleansing event, such as bathing, a showering or hair washing event. Following, or during, the cleansing event, the water discharged from the bathtub, the shower stall or the sink, flows via top opening 18, spoke openings 42 and bottom opening 20 into drain 46 and any loose hair being carried by the fluid is captured by the plurality of tines 40.

Figure 1C:
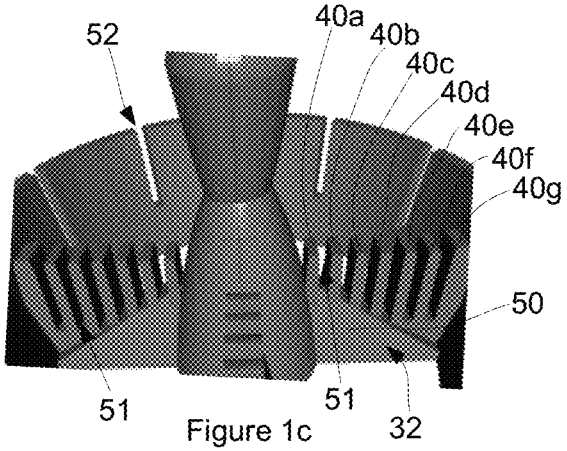
FIG. 1*c* shows a partial perspective view of the hair entrapment device.
Figure 1D:
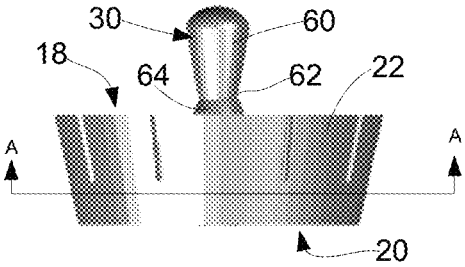
FIG. 1*d* shows a side elevational view of the hair entrapment device.
Figure 1E:
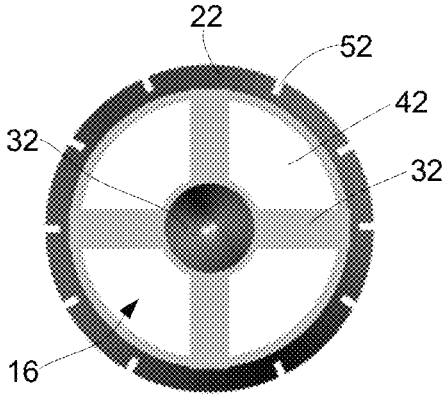
FIG. 1*e* shows a bottom view of the hair entrapment device.
Figure 1F:
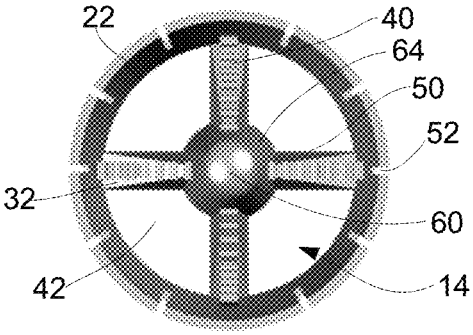
FIG. 1*f* shows a top view of the hair entrapment device.
Figure 1G:
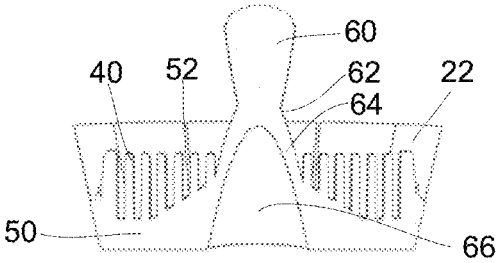
FIG. 1*g* shows a sectional view of the hair entrapment device taken along line A-A in FIG. 1*d;*

As shown in FIG. 1*c*, each spoke 32 comprises upstanding wall 50 with tines 40, which may be integrally-formed. Each of tines 40 are separated from other tines 40 by spacing 51 dimensioned to accommodate strands of hair, such human hair or pet hair. The diameter of human hair is generally known to range between 17 μm to 181 μm. In addition, the surrounding wall surface of tines 40 may be rough to enhance the capture of the hair. Sidewall 22 comprises a plurality of crevices 52 formed therethrough and extending for a predefined distance from the upper open end 14. Crevices 52 allow annular sleeve body 12 to be flexible and facilitate the installation of hair entrapment device 10 in drainage well 44 of drain 46. Accordingly, hair entrapment device 10 may be installed in differently sized drains 46. Crevices 52 may comprise different dimensions, which may impact the level of flexibility of annular sleeve body 12.

Figure 1H:
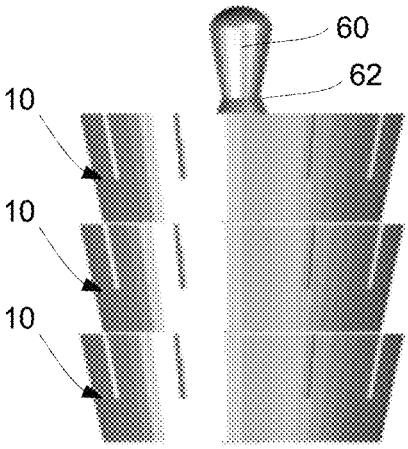
FIG. 1*h* shows stacked hair entrapment devices.
Figure 2A:
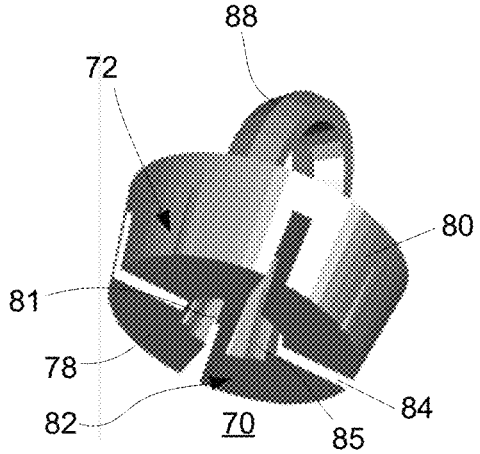
FIG. 2*a* shows a bottom perspective view of a tool for use with the hair entrapment device.
Figure 2B:
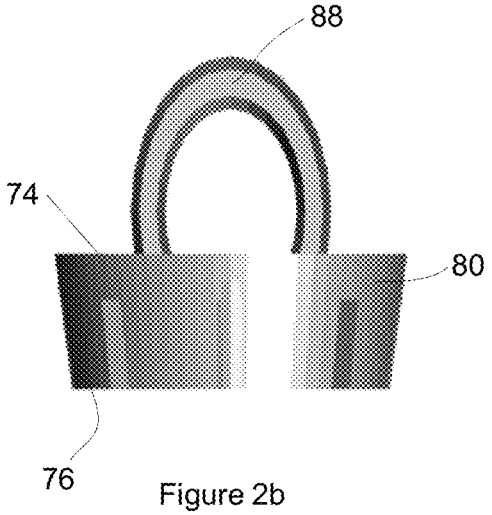
FIG. 2*b* shows a front elevational view of the tool.
Figure 2C:
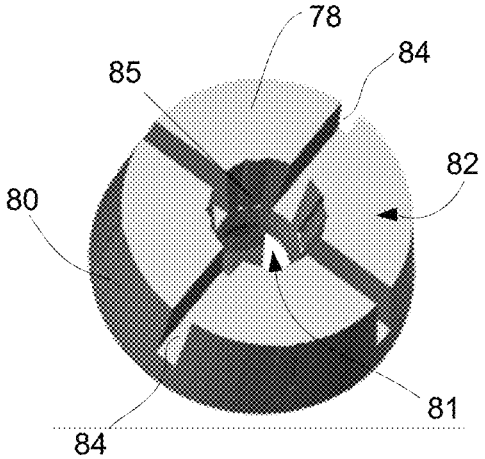
FIG. 2*c* shows a bottom perspective view of the tool.
Figure 2D:
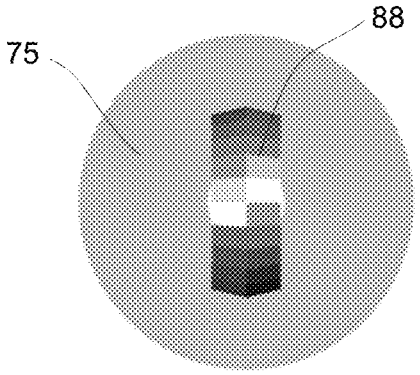
FIG. 2*d* shows a top view of the tool.
Figure 2E:
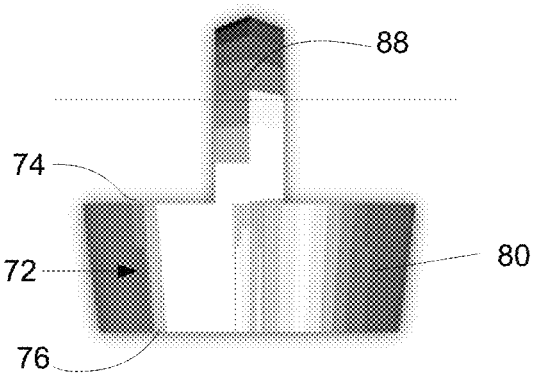
FIG. 2*e* shows a side view of the tool.
Figure 3A:
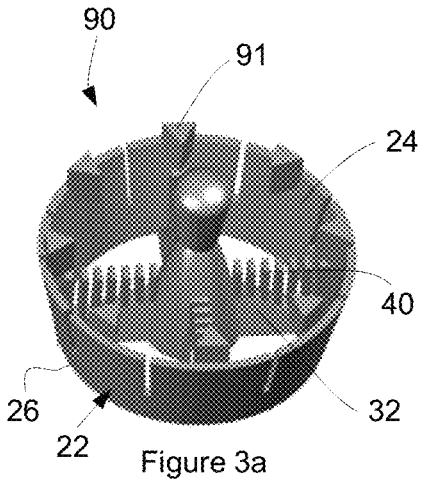
FIG. 3*a* shows a top perspective view of a hair entrapment device, in another embodiment.
Figure 3B:
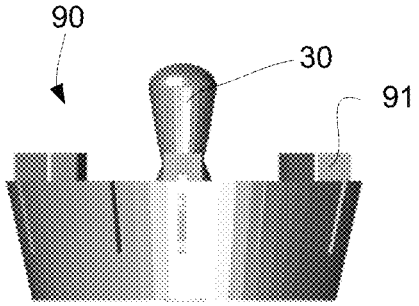
FIG. 3*b* shows a front elevational view of the hair entrapment device of FIG. 3*a;*
Figure 3C:
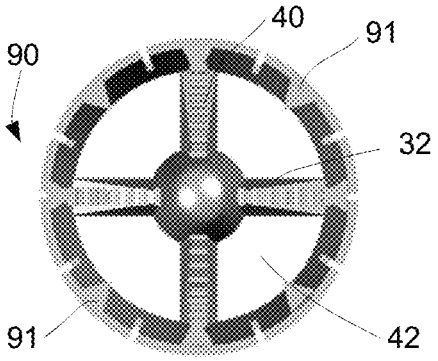
FIG. 3*c* shows a top view of the hair entrapment device of FIG. 3*a;*
Figure 3D:
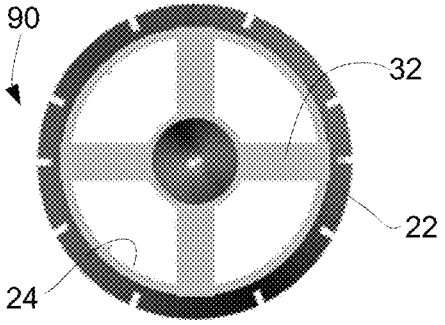
FIG. 3*d* shows a bottom view of the hair entrapment device of FIG. 3*a;*

Looking at FIGS. 1*d*-1*g*, central hub 30 comprises knob 60, neck 62 and belly 64. In one example, knob 60 and neck 62 are positioned above top opening 18. Knob 60 may be grasped by a hand or a tool when installing in drain 46 or extricating from drain 46. In one example, belly 64 comprises hollow portion 66. FIG. 1*h* shows a plurality of hair entrapment devices 10 stacked on top of each other, in which knob 60, neck 62 of one device 10 is received by hollow portion 66 of another hair entrapment device 10. Accordingly, hollow portion 66 facilitates stacking of hair entrapment device 10 for packaging, transportation, or storage when not is use.

In operation, a downward force is applied on hair entrapment device 10 to urge hair entrapment device 10 downwardly into drainage well 44 such that outer sleeve wall surface 26 of annular sleeve body 12 is in tight, sealing engagement with the drain wall 68 of drainage well 44. In one example, the force is applied to knob 60 and/or spokes 32. Fluid flows via top opening 18, spoke openings 42 and bottom opening 20 and loose hair is captured by the plurality of tines 40. Spokes 32 and spoke openings 42 are dimensioned such that the flow of water around spokes 32 into drainage well 44 is not substantially limited, and therefore flows at an acceptable rate that is substantially similar to the rate of flow without hair entrapment device 10 installed within drainage well 44. Accordingly, there is no substantial difference in the flow rate with or without hair entrapment device 10 installed within drainage well 44. In one example, hair entrapment device 10 is urged into drainage well 44 until bottom portion of sidewall 22 and bottom portions of spokes 32 are adjacent to, or abut, cross members 69 of drain 46.

In one implementation, sidewall 22 is substantially frustoconical, and tapering from upper open end 14 and lower open end 16. Frustoconical sidewall 22 aids in securement of hair entrapment device 10 within drainage well 44. Accordingly, hair entrapment device 10 is able to fit into a plurality of differently sized drains 46. For example, a portion of the tapered lower end of annular sleeve body 12 may be received within drainage well 44 while the upper portion of annular sleeve body 12 is free of drainage well 44.

As noted above, knob 60 may be grasped by a tool when installing in drainage well 44 or extricating hair entrapment device 10 from drainage well 44. FIGS. 2*a*-2*e* show various views of exemplary tool 70 which comprises unitary body 72 dimensioned to be received by hair entrapment device 10 via upper open end 14. Unitary body 72 comprises top end 74 with top wall 75, and bottom end 76 with bottom wall 78, and surrounding wall 80. Central aperture 81 extends between top wall 75 and bottom wall 78, and a plurality of fingers 82 formed from top wall 75 and bottom wall 78, with fingers 82 separated from each other by cut-outs 84 which extend from surrounding wall 80 to aperture wall 85 defining central aperture 81. As such, the shape and dimensions of the plurality of fingers 82 is complementary to the shape and dimensions of spoke openings 42, while the shape and dimensions of cut-outs 84 correspond to the shape and dimensions of spokes 32. Top wall 75 also includes handle 88 for facilitating the handling of tool 70 when installing hair entrapment device 10 in drainage well 44 or extricating hair entrapment device 10 from drainage well 46.

The operation of hair entrapment device 10 and tool 70 will now be described. In one example, before a cleansing event, such as taking a shower or washing one's hair or other hair shedding event, hair entrapment device 10 is installed in drainage well 44 associated with drain 46. When installed, outer sleeve wall surface 26 of hair entrapment device 10 is in tight, sealing engagement with the drain wall 68 of drainage well 44 with the water. During, or after, the hair shedding event loose hair that would normally flow into drainage well 44 is captured by the plurality of tines 40 of hair entrapment device 10. More specifically, a shed hair strand is carried by the flowing water towards drain 46, and as the hair strand advances into drainage well 44 a portion of the hair strand enters one or more spacings 51 of tines 40 associated with one or more of spokes 32. As the water continues to flow into drainage well 44 other portions of the hair strand also enter one or more spacings 51 of tines 40 associated with one or more of spokes 32. As the water continues to flow the process repeats itself and a sufficient portion of the hair strand is retained within spacings 51 of tines 40 such that the strand of hair is thereby prevented from going down drain 46, and the hair strand accumulates within hair entrapment device 10. Furthermore, any swirling action of the water as it enters drainage well 46 further enhances the capture of the hair strand by tines 40.

Following the hair shedding event, the accumulated, tangled loose hair may need to be removed from hair entrapment device 10 to permit re-use, alternatively, a clean or new device 10 may be used instead. Preferably, hair entrapment device 10 is extricated from drainage well 44 first. While this may be performed by inserting one's hand into drainage well 44 to grab hair entrapment device 10 by knob 60 and applying an upward force, a tool may be used, such as tool 70. Accordingly, tool 70 may be introduced into the mouth of drainage well 44, and with central aperture 81 aligned with central hub 30, cut-outs 84 aligned with spokes 32, and the plurality of fingers 82 aligned with spoke openings 42, a downward force is applied to handle 88. As the force is applied, knob 60 and neck 62 of central hub 30 are forced through aperture 86, and spokes 32 are received by cut-outs 84, and the plurality of fingers 82 are received by spoke openings 42, and belly 64 abuts aperture wall 85 of the plurality of fingers 82. Tool 70 is caused to travel down along inner sleeve wall surface 24 of sidewall 22 until bottom wall 78 of the plurality of fingers 82 is adjacent to lower open end 16, or at least until the top edge of tines 40 is adjacent to the top section of cut-outs 84, while taking into account the captured hair strands which is trapped therebetween, thereby placing tool 70 in a deployed position. From the deployed position, the combination of hair entrapment device 10 and tool 70 may be removed from drainage well 44 by pinching knob 60 and applying a lifting force to cause outer sleeve wall surface 26 of annular sleeve body 12 to slide upwardly along drain wall 68 until the combination of hair entrapment device 10 and tool 70 are out of drainage well 44, along with the trapped hair.

Figure 4:
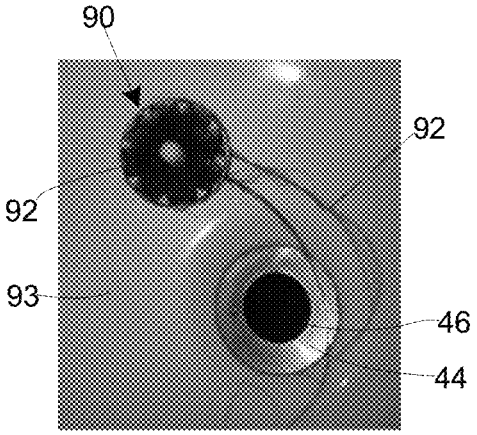
FIG. 4 shows the hair entrapment device of FIG. 3*a* with accumulated hair.

In one implementation, hair entrapment device 90 as shown in FIGS. 3*a*-3*d* comprises annular sleeve body 12, and sidewall 22 comprising inner sleeve wall surface 24 and outer sleeve wall surface 26. Hair entrapment device 90 is similar to hair entrapment device 10, however, sidewall 22 of hair entrapment device 90 comprises a plurality of upstanding posts 91 extending from upper open end 14. Looking at FIG. 4, there is shown hair entrapment device 90 that has been removed from drainage well 44 following a cleansing event in which hair 92 was shed. Loose hair 92 otherwise destined to flow down drain 46 associated with bathtub 93 and potentially result in a blockage of drain 46 is seen to have been snagged by tines 40 of hair entrapment device 90. Also, the plurality of upstanding posts 91 also snag loose hair 92, especially as water swirls down drain 46. The swirling effect caused by the water causes loose hair 92 to swirl too, and in doing so loose hair 92 wraps around posts 91 and/or tines 40, as shown in FIG. 4. Hair entrapment device 90 may be removed from drainage well 46 and the accumulated tangled loose hair 92 is removed therefrom, thereby permitting re-use of hair entrapment device 90. Alternatively, hair entrapment device 90 with the accumulated hair may be disposed of.

Figure 5:
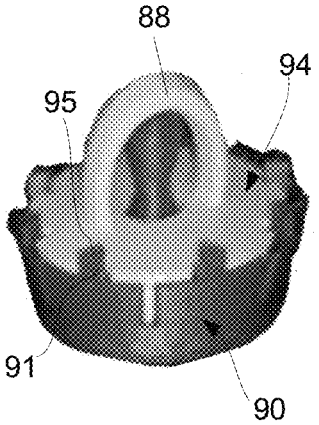
FIG. 5 shows a top perspective view of a tool received by the hair entrapment device of FIG. 3*a;*

FIG. 5 shows tool 94 installed within hair entrapment device 90 for facilitating installation of hair entrapment device 90 in drainage well 44 or extrication of hair entrapment device 10 from drainage well 44. Tool 94 is similar to tool 70, and comprises unitary body 72 dimensioned to be received by hair entrapment device 90 via upper open end 14, with surrounding wall 80. A plurality of fingers 82 are formed from adjacent top wall 75 and bottom wall 78 and fingers 82 are separated from each other by primary cut-outs 84, with central aperture 81 extending between top wall 75 and bottom wall 78. Accordingly, primary cut-outs 84 extend from surrounding wall 80 to aperture wall 85 defining central aperture 81. As such, the shape and dimension of the plurality of fingers 82 is complementary to the shape and dimension of spokes 32 and spoke openings 42. Top wall 75 also includes handle 88 for facilitating installing in drain 46 or extricating hair entrapment device 10 from drainage well 44. Secondary cut-outs 95 extend from top wall 75 to bottom wall, and secondary cut-outs 95 are dimensioned to receive upstanding posts 91 when tool 94 is installed within hair entrapment device 90, as shown in FIG. 5.

Figure 6A:
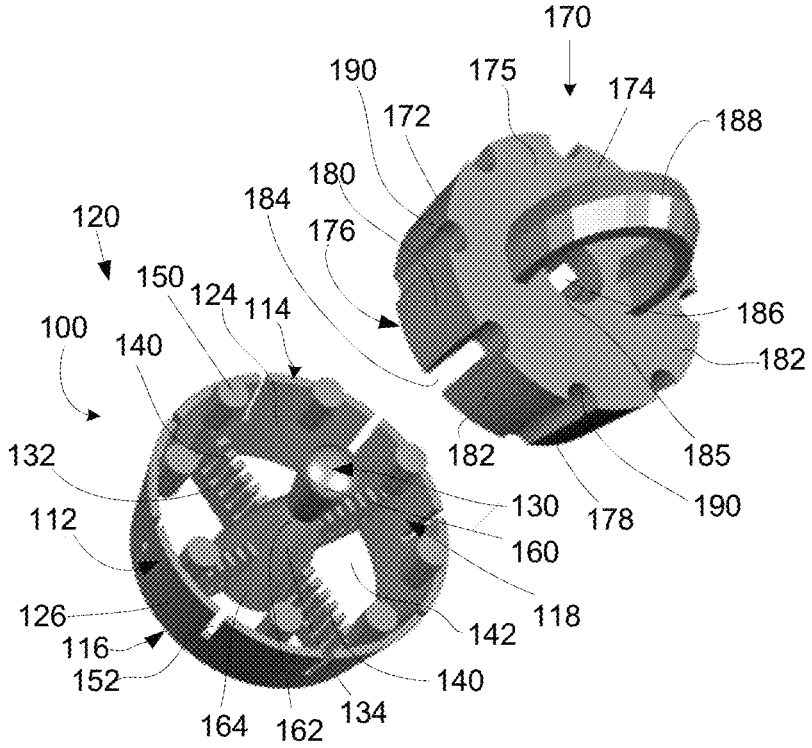
FIG. 6*a* shows a top perspective view of a hair entrapment device and a tool, in another embodiment.
Figure 6B:
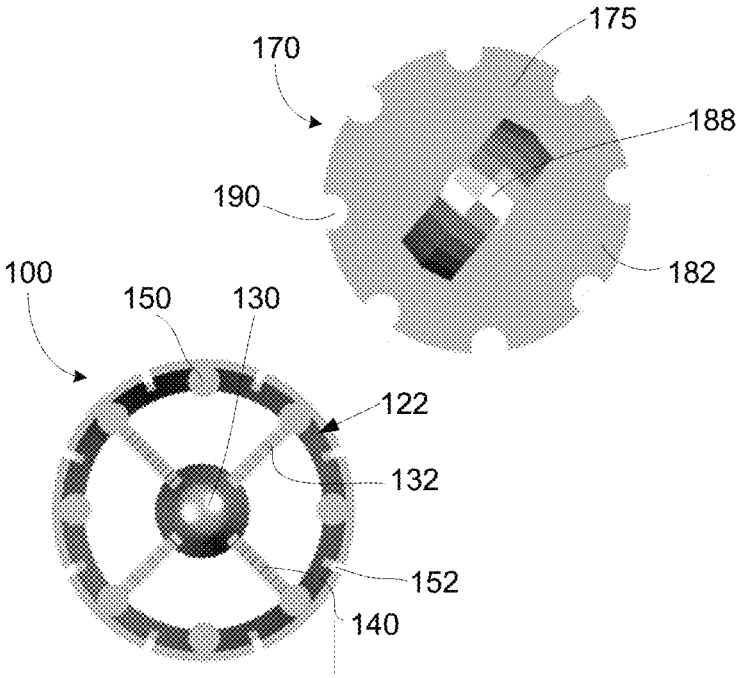
FIG. 6*b* shows an overhead view of the hair entrapment device and the tool of FIG. 6*a;*

In one implementation, there is shown in FIGS. 6*a* and 6*b* hair entrapment device 100, which is similar to hair entrapment device 10 and comprises like elements. Hair entrapment device 100 comprises annular sleeve body 112 having upper open end 114 and lower open end 116 respectively defining top opening 118 and bottom opening 120. Sidewall 122 comprises inner wall surface 124 and outer wall surface 126, extends between upper open end 114 and lower open end 116. Located in the middle of top opening 118 and bottom opening 120 of annular sleeve body 112 is central hub 130 maintained centrally within annular sleeve body 112 by a plurality of spokes 132 extending from central hub wall 134 of central hub 130 to inner wall surface 124 of the sidewall 122. Spokes 132 comprise a plurality of integrally formed tines 140 extending towards top opening 118, and spoke openings 142 are defined between spokes 122, central hub wall 134 and inner wall surface 124. Sidewall 122 comprises a plurality of upstanding posts 150 extending from upper open end 114. Sidewall 122 also comprises a plurality of crevices 152 formed therethrough and extending for a predefined distance from the upper open end 114. Crevices 152 allow annular sleeve body 112 to be flexible and facilitate the installation of hair entrapment device 100 in drainage well 44 of drain 46.

Once installed within drainage well 44, tines 140 of hair entrapment device 100 snag loose hair 92 carried by water during or after a hair shedding event, that is, loose hair 92 that would otherwise flow down drain 46 and potential result in a blockage of drain 46. The plurality of upstanding posts 150 also snag loose hair 92, especially as water swirls down drain 46. The swirling effect caused by the water causes loose hair 92 to swirl too, and in doing so loose hair 92 wraps around posts 150 and/or tines 140. Following the hair shedding event, tangled loose hair 92 is removed from hair entrapment device 100.

As shown in FIGS. 6*a* and 6*b*, central hub 130 comprises knob 160, neck 162 and belly 164. Knob 160 may be grasped by a hand or tool 170 when installing hair entrapment device 100 in drain 46 or extricating from drain 46. Tool 170 is similar to tool 70 and comprises like elements. Accordingly, tool 170 comprises unitary body 172 dimensioned to be received by hair entrapment device 10 via upper open end 114. Unitary body 172 comprises top end 174 with top wall 175, and bottom end 176 with bottom wall 178, and surrounding wall 180. A plurality of fingers 182 are formed from adjacent top wall 175 and bottom wall 178 and fingers 182 separated from each other by primary cut-outs 184 extending from surrounding wall 180 to aperture wall 185 defining central aperture 186. As such, the shape and dimension of the plurality of fingers 182 is complementary to the shape and dimension of spokes 140 and spoke openings 142. Similarly, primary cut-outs 184 are dimensioned to receive spokes 132. Top wall 175 also includes handle 188 for facilitating installing in drain 46 or extricating hair entrapment device 10 from drain 46. Secondary cut-outs 190 extend from top wall 175 to bottom wall, and secondary cut-outs 190 are dimensioned to receive upstanding posts 150 when tool 170 is installed within hair entrapment device 100.

Figure 6C:
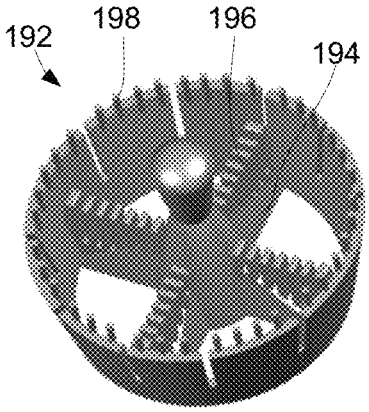
FIG. 6*c* shows a top perspective view of a hair entrapment device, in another embodiment.
Figure 6D:
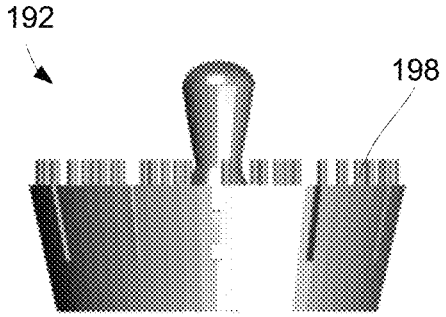
FIG. 6*d* shows a front elevational view of the hair entrapment device of FIG. 6*c;*

In one implementation, there is shown hair entrapment device 192, similar to hair entrapment device 10 and having like elements, comprising spokes 194 with tines 196, and upstanding posts 198, in FIGS. 6*c* and 6*d*.

Figure 7:
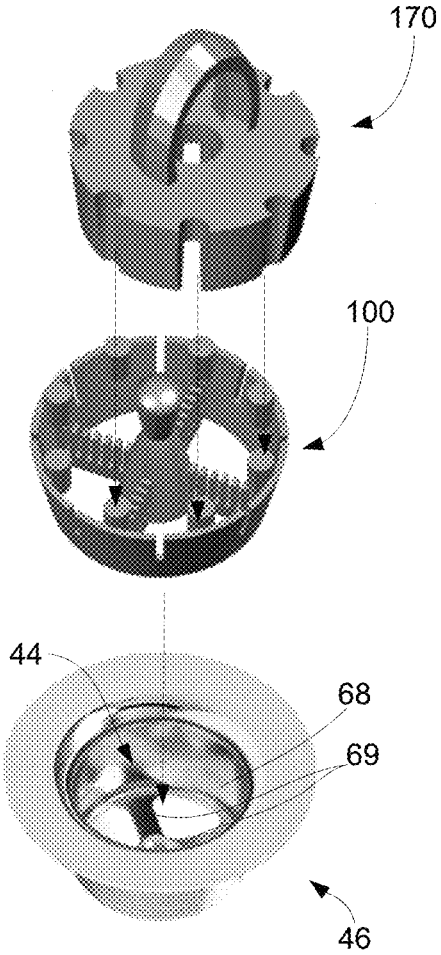
FIG. 7 shows an exploded view of the hair entrapment device, tool and a drain.
Figure 8A:
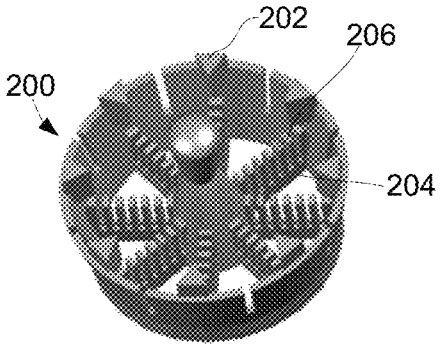
FIG. 8*a* shows a top perspective view of a hair entrapment device, in another embodiment.
Figure 8B:
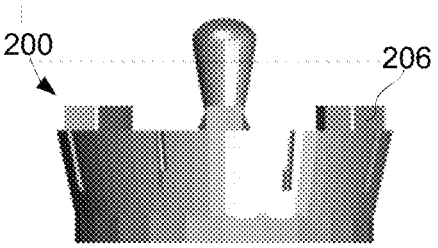
FIG. 8*b* shows a front elevational view of the hair entrapment device of FIG. 8*a;*
Figure 8C:
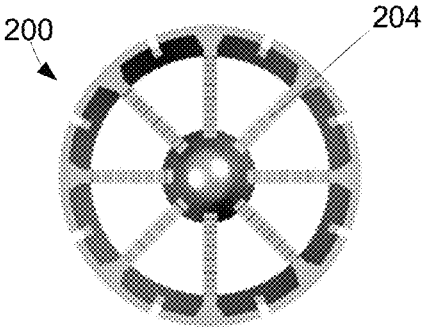
FIG. 8*c* shows a top view of the hair entrapment device of FIG. 8*a;*
Figure 8D:
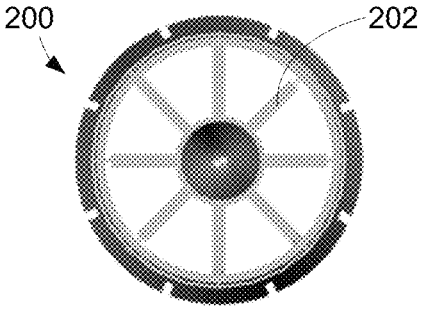
FIG. 8*d* shows a bottom view of the hair entrapment device of FIG. 8*a;*

FIG. 7 shows an exploded view of hair entrapment device 100, tool 170 and drain 46, and illustrates the alignment of the particular elements of hair entrapment device 100, tool 170 and drain 46 for installation of hair entrapment device 100 within drainage well 44 or removal of hair entrapment device 100 from drainage well 44.

In one implementation, there is shown hair entrapment device 200, similar to hair entrapment device 10 and having like elements, comprising eight spokes 202 with tines 204, and upstanding posts 206, in FIGS. 8*a*-8*d*.

Figure 9A:
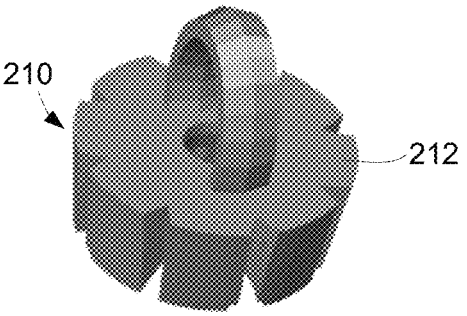
FIG. 9*a* shows a top perspective view of a tool, in another embodiment.
Figure 9B:
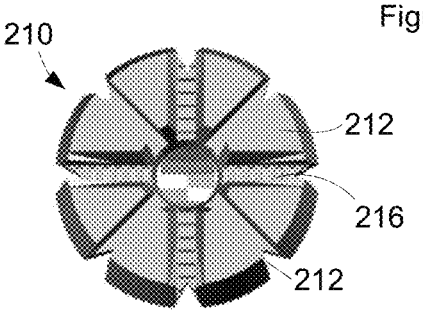
FIG. 9*b* shows a bottom view of the tool of FIG. 9*a;*
Figure 9C:
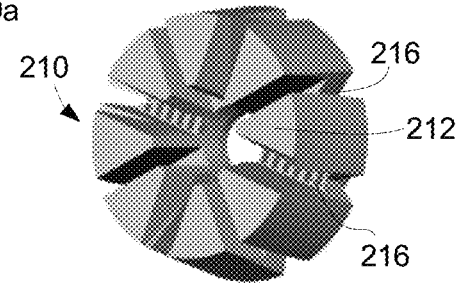
FIG. 9*c* shows a bottom perspective view of the tool of FIG. 9*a;*
Figure 10A:
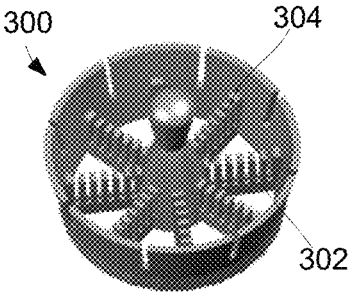
FIG. 10*a* shows a top perspective view of a hair entrapment device, in another embodiment.
Figure 10B:
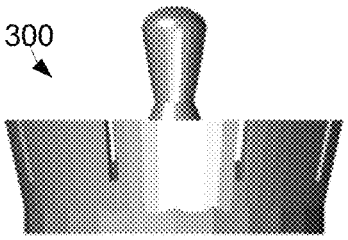
FIG. 10*b* shows a front elevational view of the hair entrapment device of FIG. 10*a;*
Figure 10C:
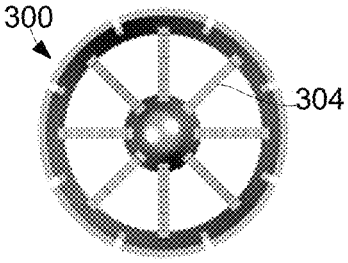
FIG. 10*c* shows a top view of the hair entrapment device of FIG. 10*a;*
Figure 10D:
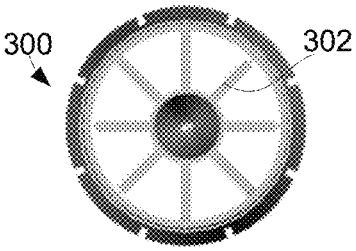
FIG. 10*d* shows a bottom view of the hair entrapment device of FIG. 10*a;*
Figure 11A:
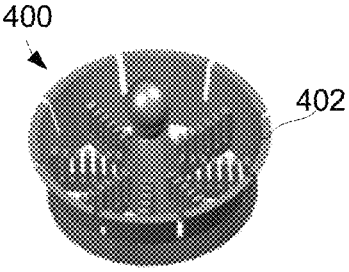
FIG. 11*a* shows a top perspective view of a hair entrapment device, in another embodiment.
Figure 11B:
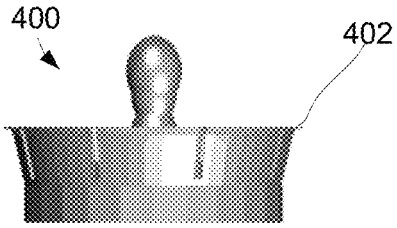
FIG. 11*b* shows a front elevational view of the hair entrapment device of FIG. 11*a;*
Figure 11C:
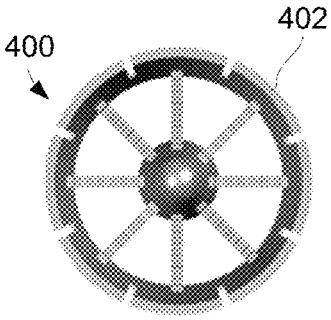
FIG. 11*c* shows a top view of the hair entrapment device of FIG. 11*a;*
Figure 11D:
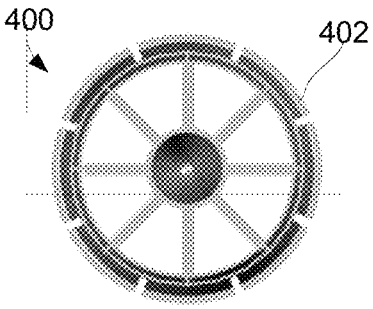
FIG. 11*d* shows a bottom view of the hair entrapment device of FIG. 11*a*.

In one implementation, there is shown tool 210, similar to tool 70 and having like elements, comprising eight fingers 212, eight primary cut-outs 214 for receiving tines 204 of hair entrapment device 200 and eight secondary cut-outs 216 for receiving upstanding posts 206, in FIGS. 9*a*-9*c*.

In one implementation, there is shown hair entrapment device 300, similar to hair entrapment device 10 and having like elements, comprising eight spokes 302 with tines 304, in FIGS. 10*a*-10*d*.

In one implementation, there is shown hair entrapment device 400 similar to hair entrapment device 10 and having like elements, in FIGS. 11*a*-11*d*. Sidewall 22 of hair entrapment device 400 comprises flange 402 extending from outer sleeve wall surface 26. For example, flange 402 may extend from outer sleeve wall surface 26 adjacent to upper open end 14. Flange 402 may facilitate installation of hair entrapment device 400 in differently-sized drainage wells 44.

Figure 12:
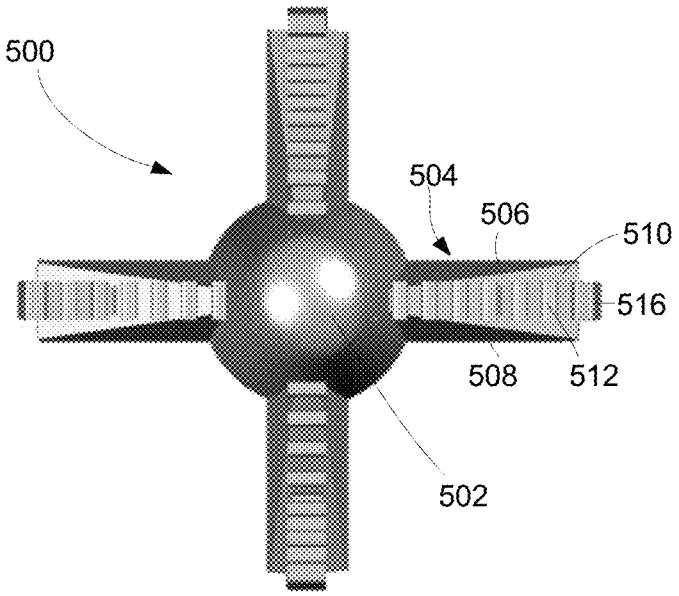
FIG. 12 shows a top view of a hair entrapment device, in yet another embodiment.

In one implementation, there is shown hair entrapment device 500 comprising central hub 502, a plurality of spokes 504 extending from central hub 502, in FIG. 12. Each of the plurality of spokes 504 comprises opposed side walls 506, 508, top wall 510 with a plurality of tines 512, bottom wall 514 and distal wall 516. Hair entrapment device 500 is installed in drainage well 44 as described above such that distal wall 516 abuts inner surface wall of drainage well 44. Accordingly, in use, water flows between openings defined spokes 504 and drain wall 68 of drainage well 44, and loose hair is held between the plurality of tines 512.

In one implementation, unitary body 72 of tool 70 is substantially frustoconical, and tapering from top end 74 and bottom end 76; and unitary body 172 of tool 170 is substantially frustoconical, tapering from top end 174 and bottom end 176.

In one implementation, hair entrapment devices 10, 90, 100, 192, 200, 210, 300, 400, 500 are made of any suitable material.

In one implementation, hair entrapment devices 10, 90, 100, 192, 200, 210, 300, 400, 500 are made of a flexible, suitable resilient plastic or elastomeric material. Exemplary materials comprise any of a stiff synthetic rubber material, a polyolefin, a polyvinylchloride, a polyamine resin, or the like.

In one implementation, hair entrapment devices 10, 90, 100, 192, 200, 300, 400 and tools 70, 170, 210 are biodegradable. In one example, hair entrapment devices 10, 90, 100, 192, 200, 210, 300, 400, 500 are made of polylactic acid (PLA).

In one implementation, hair entrapment devices 10, 90, 100, 192, 200, 210, 300, 400, 500 are made of any of a metal and a metal chrome.

In one implementation, a combination of hair entrapment device 10, 90, 100, 192, 200, 300, 400, 500 and tool 70, 170, 210 acts a drainage well stopper or plug.

In one implementation, tines 40*a*-*g* may comprise varying dimensions, with tines 40*a* closest to central hub wall 34 being substantially longer than tines 40*g* adjacent to inner sleeve wall surface 24.

In one implementation, tines 40*a*-*g* comprise identical dimensions.

In one implementation, tines 40*a*-*g* comprise varying dimensions. In one example, tines 40*a*-*g* comprise different lengths, different widths, different breadths.

In one implementation, tines 40*a*-*g* may be positioned in any configuration. For example, tines 40*a*-*g* may comprise alternating heights, or tines 40*a* closest to central hub wall 34 and tines 40*g* adjacent to inner sleeve wall surface 24 may be substantially longer than tines 40*b*-*f*, or versa.

In one implementation, tines 40 are formed on a separate body that is removably attached to spokes 32. Accordingly, once hair has accumulated on tines 40, the body may be removed from spokes 32 and the body with the accumulated hair is disposed of. Accordingly, the removably attached tines 40 may be a disposable accessory, should the user choose not to remove the accumulated hair for re-use of tines 40.

The benefits and advantages described above may relate to one embodiment or may relate to several embodiments. The embodiments are not limited to those that solve any or all of the stated problems or those that have any or all of the stated benefits and advantages. The operations of the methods described herein may be carried out in any suitable order, or simultaneously where appropriate. Additionally, individual blocks may be added or deleted from any of the methods without departing from the spirit and scope of the subject matter described herein. Aspects of any of the examples described above may be combined with aspects of any of the other examples described to form further examples without losing the effect sought.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises," "comprising," or any other variations thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized and that logical and mechanical changes may be made without departing from the spirit and scope of the invention. For example, the steps recited in any of the method or process claims may be executed in any order and are not limited to the order presented. Thus, the preceding detailed description is presented for purposes of illustration only and not of limitation, and the scope of the invention is defined by the preceding description, and with respect to the attached claims.

The invention claimed is:

1. A hair entrapment device for retaining loose hair entering a drainage well of a drain, the device comprising:

an annular sleeve body having an upper open end and a lower open end respectively defining a top opening and a bottom opening, the annular sleeve body comprising a sidewall extending between the upper open end and the lower open end;

a central hub;

a plurality of planar spokes radially extending between the central hub and portions of an inner surface of the sidewall, defining spoke openings between the central hub, the spokes and the inner surface; and a plurality of tines extending from a top surface of the spokes towards the top opening, each of the plurality of tines being spaced a parallel distance from each other, defining channels substantially uniform in width therebetween, wide enough to receive strands of hair therein;

wherein fluid flows the through the top opening, through the spoke openings and through the bottom opening into the drain and any loose hair flowing therewith, is retained in the channels substantially uniform in width between the plurality of tines.

2. The hair entrapment device of claim 1, wherein the sidewall is substantially frustoconical and tapered inwardly from the upper open end to the lower open end.

3. The hair entrapment device of claim 1, wherein the annular sleeve body is detachably engageable with a wall of the drainage well.

4. The hair entrapment device of claim 1, wherein the annular sleeve body comprises a resilient material.

5. The hair entrapment device of claim 1, wherein the sidewall comprises a plurality of crevices formed therethrough and extending for a predefined length from the upper open end.

6. The hair entrapment device of claim 1, wherein at least some of the plurality of tines extend different distances.

7. The hair entrapment device of claim 1, wherein the plurality of planar spokes are substantially triangular in shape.

8. The hair entrapment device of claim 1, wherein the sidewall comprises upstanding posts extending beyond the upper open end.

9. The hair entrapment device of claim 1, wherein the hub further comprises a knob for grasping.

10. The hair entrapment device of claim 1, wherein the sidewall further comprises a flange.

11. The hair entrapment device of claim 1, wherein the device is constructed and arranged such that a plurality of hair entrapment devices are capable of being stacked on top of each other in a nested manner.

12. The hair entrapment device of claim 1, wherein at least some components of the device are made from a synthetic rubber.

13. The hair entrapment device of claim 1, wherein at least some components of the device are made from polylactic acid.

14. The hair entrapment device of claim 1, wherein at least some components of the device are made from a metal.

15. The hair entrapment device of claim 1, wherein at least some components of the device are made from a polyolefin.

16. The hair entrapment device of claim 1, wherein at least some components of the device are made from a polyvinylchloride.

17. The hair entrapment device of claim 1, wherein at least some components of the device are made from a polyamine resin.

* * * * *